US005909735A

United States Patent [19]

Knudsen

[11] Patent Number: 5,909,735

[45] Date of Patent: Jun. 8, 1999

[54] SMOKING ARTICLE HOLDER

[76] Inventor: Peter Carl Knudsen, 16 E. 134th St., Kansas City, Mo. 64145

[21] Appl. No.: 08/859,615

[22] Filed: May 20, 1997

[51] Int. Cl.[6] ..... A24F 9/14

[52] U.S. Cl. ..... 131/257; 131/331

[58] Field of Search ..... 131/331, 248, 131/255, 250, 252, 253, 257

[56] References Cited

U.S. PATENT DOCUMENTS

| | | | |
|---|---|---|---|
| 578,652 | 3/1897 | Morrison | 131/256 |
| 1,090,716 | 3/1914 | Howe | 131/256 |
| 1,198,929 | 9/1916 | Knudsen | 131/256 |
| 1,874,045 | 8/1932 | Jefferies | 131/257 |
| 3,001,529 | 9/1961 | Watson | 131/257 |
| 3,528,591 | 9/1970 | Von Herbulis | 131/256 |
| 4,032,054 | 6/1977 | Duncan | 131/256 |
| 4,709,706 | 12/1987 | Turro | 131/256 |
| 4,838,285 | 6/1989 | Petrone | 131/256 |
| 5,305,999 | 4/1994 | Tate | 131/256 |
| 5,401,019 | 3/1995 | Wissman et al. | 131/256 |
| 5,588,448 | 12/1996 | Photakis | 131/256 |

OTHER PUBLICATIONS

Article located on the Internet titled *The Golf Survival Tool*; dated Apr. 29, 1997.

*Primary Examiner*—John G. Weiss
*Assistant Examiner*—Charles W. Anderson
*Attorney, Agent, or Firm*—Jennifer H. Hammond; Sonnenschein Nath & Rosenthal

[57] ABSTRACT

A smoking article holder that is lightweight, inexpensive and can be used to retain a player's smoking article during a round of golf. The holder comprises a generally oblong member for receiving and retaining the smoking article, a pin extending from the oblong member and a retractable clamp attached to the oblong member which retains the smoking article against the oblong member. While the holder may be placed in the ground, the pin extending from the oblong member is designed to fit snugly in one of the tee holder holes provided in the dash of a golf cart.

7 Claims, 3 Drawing Sheets

SMOKING ARTICLE HOLDER

BACKGROUND OF THE INVENTION

The field of the invention relates generally to holders for smoking articles, and more particularly, to holders which can be used while playing golf.

It is currently trendy to smoke cigars while engaged in sporting activities; the most popular of which appears to be golf. On the golf course, players have ample time to enjoy a smoke while waiting on their opponents or partners and while traveling to their next shot. However, there is no good place to leave one's cigar when hitting or engaging in other activities. As such, the golfer is typically forced to place the cigar on the ground. Placing the cigar on the ground often leads to contamination of the cigar with dirt, chemicals and insects, or the ground is so wet that the lit cigar is extinguished. Additional, some individuals may tend to forget their cigars when placed on the ground.

Previous efforts have been made to provide a smoking article holder that holds a player's cigar while he or she is engaging in a sporting activity. One such holder is disclosed in Photakis, U.S. Pat. No. 5,588,448. U.S. Pat. No. 5,588,448 discloses a holder having a slot on its underside for receiving a tee. The tee can then be placed in the ground and a cigar or other smoking article can then rest on the holder. Unlike the present invention, this device does not have a clamp means for securing the cigar against the holder nor is the device adapted to fit in the dash of a golf cart; it can only be used in the ground.

SUMMARY OF THE INVENTION

Accordingly, the general object of the present invention is to overcome the disadvantages of the prior art by producing a smoking article holder that can be used in connection with a golf cart. This holder is particularly adapted to allow the cigar or other smoking article to be left in the golf cart while the player is teeing off, shooting, putting, driving or attending to other matters. Leaving the cigar in the cart makes it easier for the golfer because the golfer does not have to hassle with taking the holder out of his pocket and placing it on the ground each time he or she takes a shot. Additionally, the golfer is less prone to forget the cigar when he is able to leave it in the cart.

Yet another object of the present invention is to provide a holder which is designed so that it can also be placed on the ground. Thus, a golfer can still use the holder on those days that he or she opts to walk rather than ride a course. Also, the holder is designed so that advertisements can be placed on the holder. Still, additional objects of the present invention include providing a smoking article holder that is: (1) lightweight; (2) small; (3) inexpensive; and (4) durable.

In keeping with these objects, one form of the invention, briefly stated, resides in a smoking article holder that comprises a holder, having a generally oblong member for receiving and retaining a smoking article, a pin extending laterally from the oblong member and a retractable clamp attached to the oblong member which retains the smoking article against the oblong member. The pin is designed to fit snugly within one of tee holder holes provided in the dash of a golf cart.

The novel features which are considered as characteristic for the invention are set forth in particular in the appended claims. The invention itself, however, both as to construction and its method of operation, together with additional objects and advantages thereof, will be best understood from the following description of the preferred embodiment when read in connection with the accompanying drawings.

DETAILED DESCRIPTION OF PREFERRED EMBODIMENT

Figure 1:
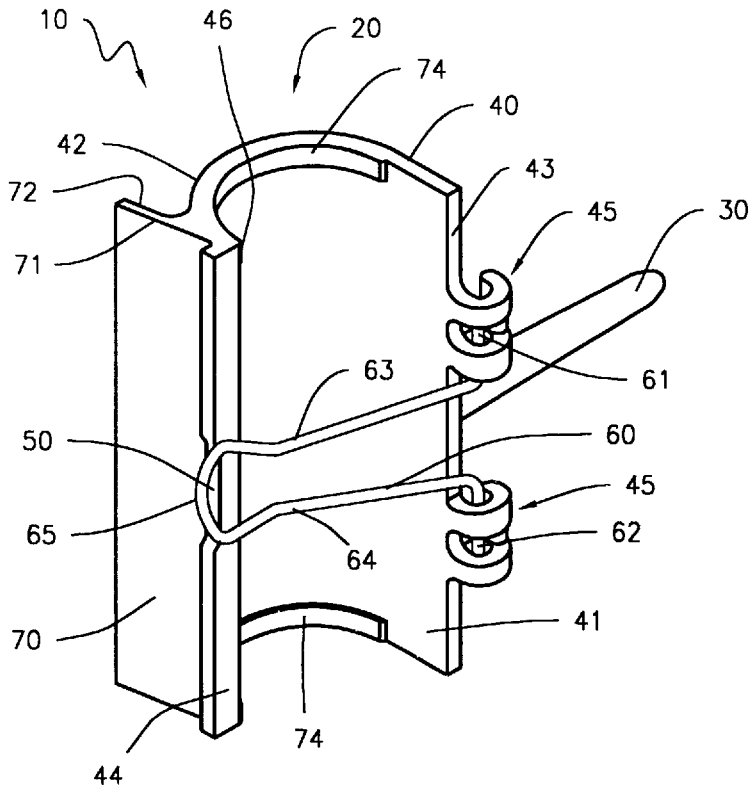
FIG. 1 is a perspective view of the smoking article holder of the present invention.

As seen from all the accompanying drawings, the present invention relates to a smoking article holder 10 which comprises a receptacle or receiving means 20 for receiving a smoking article (e.g. cigar) and a pin 30 extending from the receptacle 20. As seen in FIG. 1, the receptacle 20 comprises a generally oblong member 40 having (1) a seat 41 comprising a concave upper surface; (2) a concave lower surface 42; (3) front edge 46; (4) a front lip 44; and (5) a rear edge 43. The oblong member 40 is made of a heat resistant plastic or like material.

Figure 2:
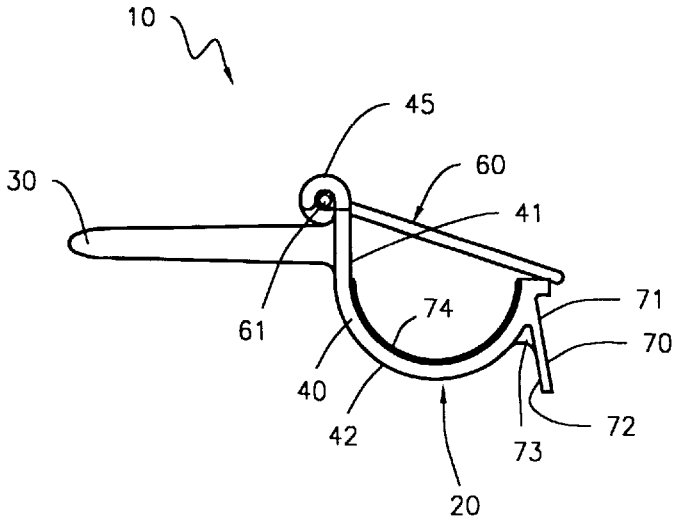
FIG. 2 is a side elevational view of the smoking article holder of the present invention.
Figure 3:
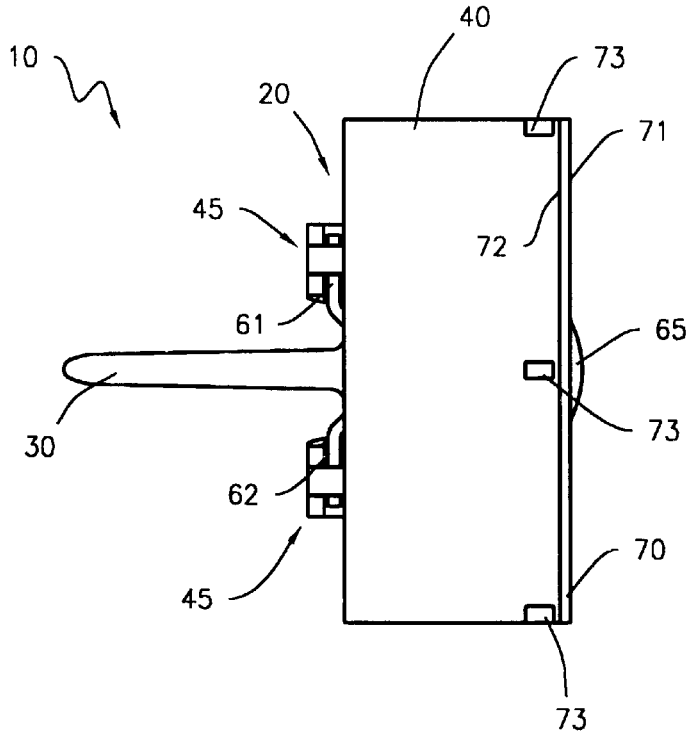
FIG. 3 is a bottom plan view of the smoking article holder of the present invention.
Figure 4:
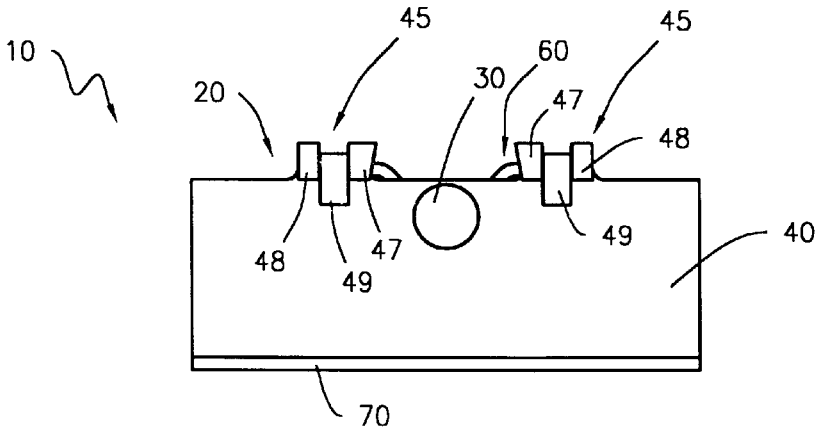
FIG. 4 is a rear elevational view of the smoking article holder.

Referring to FIGS. 2 and 4, the pin 30 extends laterally from the lower surface 42 of the oblong member 40. The pin 30 is designed at a width and depth to fit snugly within the tee holder holes which are found in the dash of most golf carts. The pin 30 extends outward and away from the oblong member 40 at an angle that allows a cigar to be substantially horizontally maintained in the seat 41 of the oblong member 40 when the pin 30 is positioned in a tee holder hole in a golf cart.

As shown in FIGS. 1–5, the oblong member 40 has two identically opposing curved flanges 45 which extend from the rear edge of the oblong member 40. These opposing curved flanges 45 hold the free ends 61 and 62 of a retractable clamp 60. The retractable clamp 60 is made of a slightly resilient or spring-like wire material which acts to retain a cigar against the seat 41 of the oblong member 40 when the clamp 60 is in its closed position, as shown in FIGS. 1 and 2.

As seen in FIG. 1, the retractable clamp 60 is a generally U-shaped clamp having two side wires 63 and 64 and two free ends 61 and 62 extending therefrom. The two side wires 63 and 64 meet at a point opposite the free ends 61 and 62 to form a lifting end 65. When the clamp 60 is in its closed position, the lifting end 65 of the clamp 60 extends slightly beyond the front lip 44 of the oblong member 40. By extending the lifting end 65 slightly beyond the front lip 44, a user is able to grip the clamp 60 or easily push the clamp 60 into its open position. To further facilitate the ease of raising the clamp 60 into its upright and open position, the front lip 44, as illustrated in FIG. 1, may be designed with a groove 50, which is positioned where the lifting end 65 rests upon the lip 44.

Figure 5:
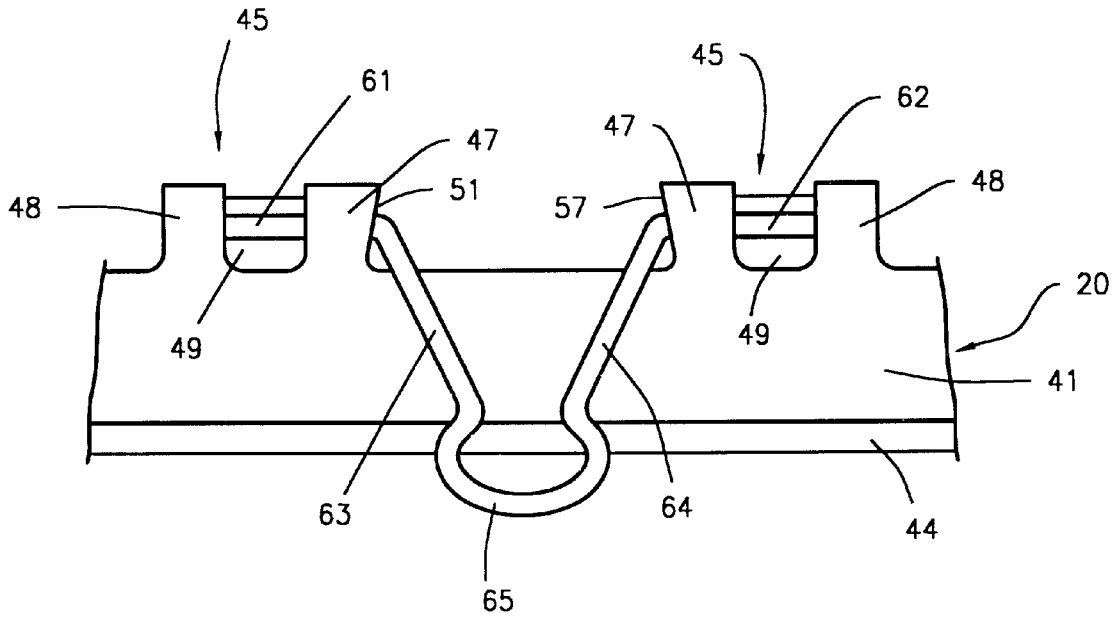
FIG. 5 is a fragmentary front elevational view of the smoking article holder of the present invention.

As illustrated in FIGS. 1–5, each of the curved flanges 45 comprises three looping members: an exterior loop 48; an interior loop 47; and a center loop 49. As seen in FIG. 5, both the interior loop 47 and exterior loop 48 extend outward and away from the seat 41 of the oblong member 40. The center loop 49, however, extends inward and toward the seat 41 of the oblong member 40. The exterior 48, interior 47 and center 49 loops are spatially positioned to receive and maintain the respective free ends 61 and 62 of the clamp 60.

Referring again to FIG. 5, the inner edges 51 of the interior loops 47 are angled slightly inward so that the width of the interior loops 47 at their midpoints is greater than at their ends. This angling of the inner edges 51 of the interior loops 47 places tension on the side wires 63 and 64 of the clamp 60 and serves to provide a force which maintains the clamp 60 in either its closed or open position. Thus, the clamp 60 cannot be opened or closed without applying upward or downward pressure on the lifting end 65 of the clamp 60.

To lift the clamp 60 into its open and upright position, a user must apply enough upward pressure on the clamp to overcome the angle of the interior loops 47. When pushing the clamp open, the angling of the inner edges 51 forces the side wires 63 and 64 toward one another. This creates tension on the side wires 63 and 64. Once beyond the midpoint of the inner edge 51, the slope of the angle decreases and allows the side wires 63 and 64 to retract to their original positions. When returning the clamp 60 to its closed position, tension is again placed on the side wires 63 and 64 by the angling of the inner edges 51. Once beyond the midpoint of the inner edges 51, the side wires 63 and 64 return again to their relaxed position.

Narrow strips 74 may be placed on the seat 41 of the oblong member 40. These strips 74 help maintain a smoking article within the seat 41 of the oblong member 41 by placing friction on the smoking article and increasing the amount of pressure applied on a smoking article by the clamp 60 when in its closed position.

Another optional feature of the smoking article holder 10 is a display panel 70. FIGS. 1–4 show a display panel 70 extending from the under side of the lip 44 of the oblong member 40. This display panel 70 has a front side 71 and a back side 72. The front side 71 of the display panel 70 provides a long flat surface for displaying advertisements.

To prevent the display panel 70 from breaking away from the oblong member 40, the panel 70 is supported from behind by a plurality of support members 73 (FIG. 3) extending between the lower surface of the oblong member 40 and the back side 72 of the display panel 70.

During a game of golf, a player places the pin 30 of the holder 10 in one of the tee holes in the dash of a golf cart. The pin 30 is larger in diameter than a standard golf tee, such that the holder 10 is rigidly held in the tee hole. A cigar can then be placed in the seat 41 of the holder 10 by applying enough pressure to the underside of the lifting end 65 of the clamp 60 to raise the clamp 60 to its open and upright position. Once the cigar is resting on the seat 41 of the holder 41, the player can then return the clamp 60 to its closed position by applying downward pressure on the clamp 60. When in its closed position, the clamp 60 will retain the cigar securely against the seat 41 of the holder 10. Although the holder 10 is designed to be used in connection with the tee holes in golf carts, a player may also use the holder by placing the pin 30 in the ground. Despite the entry angle of the pin 30 into the ground, the clamp 60 will retain the cigar securely against the seat 41 of the holder 10.

Although the foregoing detailed description of the present invention has been described by reference to a single exemplary embodiment, and the best mode contemplated for carrying out the present invention has been herein shown and described, it will be understood that modifications or variations in the structure and arrangement of this embodiment other than those specifically set forth herein may be achieved by those skilled in the art and that such modifications are to be considered as being within the overall scope of the present invention. Therefore, it is contemplated to cover the present invention and any and all modifications, variations, or equivalents that fall within the true spirit and scope of the underlying principles disclosed and claimed herein. Consequently, the scope of the present invention is intended to be limited only by the attached claims.

What is claimed and desired to be secured by Letters Patent is as follows:

1. A smoking article holder for retaining a smoking article comprising:

(a) a generally oblong member having a concave upper surface, a concave lower surface, a rear edge and a front edge, the rear edge of said generally oblong member being slightly higher than the front edge of said generally oblong member;

(b) a means for retaining a smoking article against said generally oblong member; and (c) a pin extending from the lower surface of said generally oblong member below the rear edge of said generally oblong member such that said pin is in a generally parallel plane with the top of the front edge of said generally oblong member.

2. A smoking article holder as recited in claim 1, wherein said retaining means comprises a retractable clamp mounted to said generally oblong member, said retractable clamp assisting in retaining the smoking article against said generally oblong member when said retractable clamp is in its closed position.

3. A smoking article holder as recited in claim 2, wherein said generally oblong member further comprises at least one flange extending from the rear edge of said generally oblong member for attaching said retractable clamp to said generally oblong member.

4. A smoking article holder as recited in claim 1, wherein said generally oblong member further comprises a front lip extending from the front edge of said generally oblong member.

5. A smoking article holder as recited in claim 1, wherein said generally oblong member further comprises a display panel attached to and extending from said generally oblong member.

6. A smoking article holder for retaining a smoking article comprising:

(a) a generally oblong member having a concave upper surface, a concave lower surface, a rear edge and a front edge, the rear edge of the generally oblong member being slightly higher than the front edge of said generally oblong member;

(b) a retractable clamp mounted to said generally oblong member, said retractable clamp assisting in retaining the smoking article against said generally oblong member when said retractable clamp is in its closed position;

(c) a pin extending from the lower surface of said generally oblong member below the rear edge of said generally oblong member such that said pin is in a generally parallel plane with the top of the front edge of said generally oblong member; and (d) a display panel attached to and extending from said generally oblong member.

7. A smoking article holder for retaining a smoking article comprising:

(a) a generally oblong member having a concave upper surface, a concave lower surface, a rear edge and a front edge, the rear edge of the generally oblong member being slightly higher than the front edge of said generally oblong member;

(b) a retractable clamp mounted to said generally oblong member, said retractable clamp assisting in retaining the smoking article against said generally oblong member when said retractable clamp is in its closed position;

(c) a pin extending from the lower surface of said generally oblong member below the rear edge of said generally oblong member such that said pin in a generally parallel plane with the top of the front edge of said generally oblong member; and (d) at least one strip positioned on the upper surface of said generally oblong member, said strip placing friction on the smoking article and increasing the amount of pressure applied on a smoking article by said retractable clamp when said retractable clamp is in its closed position.

* * * * *